US006313450B1

(12) United States Patent
Han et al.

(10) Patent No.: US 6,313,450 B1
(45) Date of Patent: Nov. 6, 2001

(54) MICROWAVE OVEN CAPABLE OF SUPPLYING AC POWER

(75) Inventors: Yong-woon Han, Kunpo; Seong-deog Jang; Kwang-seok Kang, both of Suwon; Han-jun Sung, Seoul, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/501,629

(22) Filed: Feb. 10, 2000

(30) Foreign Application Priority Data

Sep. 21, 1999 (KR) ..... 99-40701

(51) Int. Cl.[7] ..... H05B 6/68

(52) U.S. Cl. ..... 219/702; 219/715; 219/756; 219/760

(58) Field of Search ..... 219/702, 715, 219/716, 756, 760

(56) References Cited

U.S. PATENT DOCUMENTS

| | | | | |
|---|---|---|---|---|
| 4,332,993 | * | 6/1982 | Shibahara et al. | 219/757 |
| 4,866,572 | * | 9/1989 | Blodgett | 219/387 |
| 4,904,837 | * | 2/1990 | Low et al. | 219/715 |
| 5,321,235 | * | 6/1994 | Makino et al. | 219/716 |
| 5,347,109 | * | 9/1994 | Nakabayashi et al. | 219/716 |

FOREIGN PATENT DOCUMENTS

| | | | | |
|---|---|---|---|---|
| 0 171 170 A2 | * | 2/1986 | (EP) . | |
| 2 206 750 A | * | 1/1989 | (GB) . | |
| 58-18895 | * | 2/1983 | (JP) . | |
| 6-243962 | * | 9/1994 | (JP) | 219/702 |

* cited by examiner

*Primary Examiner*—Philip H. Leung
(74) *Attorney, Agent, or Firm*—Robert E. Bushnell, Esq.

(57) ABSTRACT

A non-directional frequency generator inputs direct current power and outputs alternating current power. A high voltage transformer inputs the alternating current power, and either induces a higher voltage for driving the magnetron, or induces and outputs a commonly used alternating current power. A button inputting section includes a microwave oven operating button for driving the magnetron, and a voltage supplying button for supplying the commonly used alternating current power. A microcomputer applies the higher voltage of the high voltage transformer to the magnetron when there is a button input through the microwave oven operating button, while outputting the commonly used alternating current power when there is a button input through the voltage supplying button. Further, a socket outlet is formed on the body of the microwave oven, through which the commonly used alternating power generated at the microwave oven is supplied. Accordingly, since the commonly used alternating current power is supplied from an AC/DC type microwave oven, a user can use AC type electric appliances in places where alternating current is unavailable.

18 Claims, 3 Drawing Sheets

MICROWAVE OVEN CAPABLE OF SUPPLYING AC POWER

CLAIM OF PRIORITY

This application makes reference to, incorporates the same herein, and claims all benefits accruing under 35 U.S.C. §§119 from an application for AC/DC Microwave Oven Capable of Supplying an Electric Power earlier filed in the Korean Industrial Property Office on Sep. 21, 1999 and there duly assigned Ser. No. 1999-40701.

BACKGROUND OF THE INVENTION

1. Field of the Invention

The present invention relates to a microwave oven, and more particulary to a microwave oven capable of supplying alternating current power to outer electronic appliances.

2. Description of the Related Art

Generally, a microwave oven is designed to be driven solely by alternating current (hereinafter called AC) power, and accordingly requires an inverter for converting direct current (hereinafter called DC) power into AC power in the places where the AC power is not available.

Regarding the inverter for converting the DC power to AC power, the same applicant disclosed a non-directional frequency generator (hereinafter called NDFG) using rotational AC converting means for converting DC power into AC power in the Korean Patent Application Nos. 98-18589 (filed May 22, 1998) and 98-21117 (filed Jun. 8, 1998), which have not been opened to the public yet.

Hereinafter, the above NDFG will be briefly described as a related art with reference to the accompanying drawings.

FIG. 1 is a schematic view for showing the NDFG of a microwave oven driven by the DC power according to the related art of the present invention.

Referring to FIG. 1, the NDFG 100 includes a motor 110 driven by the DC for generating rotational force, a commutator 130 rotated by the motor 110, and a plurality of brushes such as first, second, third, and fourth brushes 121–124 as shown in FIG. 1, which are in contact with the outer circumference of the commutator 130. The commutator 130 includes a conductive part which is divided into an even number of parts, but into at least two parts 132*a* and 132*b* as shown in FIG. 1. The conductive parts 132*a* and 132*b* have an insulating part 133 of a certain width formed therebetween. The conductive parts 132*a* and 132*b* are in simultaneous contact with at least two neighboring brushes of the brushes 121–124. The DC is applied to the input sides of the first to fourth brushes 121–124, while the output sides of the first to fourth brushes 121–124 are connected with a high voltage transformer (hereinafter called HVT).

Such a NDFG supplies the AC power while the brushes 121–124 thereof come in contact with the respective parts formed on the outer circumference of the commutator 130, sequentially.

Once the AC power is generated, the AC power is applied to a primary coil of the HVT, and the AC power applied to the primary coil is stepped up to a higher voltage at a secondary coil of the HVT. By the higher voltage, the magnetron MGT is driven to generate the microwaves.

Although the microwave oven according to the related art of the present invention is capable of converting DC power into AC power, the microwave oven has an inefficiency in that the AC power generated at the microwave oven can not be supplied to the any outer electric appliances.

SUMMARY OF THE INVENTION

The present invention has been developed to overcome that above-mentioned problem of the related art, and accordingly, it is an object of the present invention to provide a microwave oven capable of supplying alternating current power which is converted from direct current power to other external electronic appliances.

The above object is accomplished by an AC/DC type microwave oven according to the present invention, including: a non-directional frequency generator for inputting direct current power and outputting alternating current power; a transformer for inducing the alternating current power outputted from the non-directional frequency generator into a certain alternating current power of a predetermined voltage, and for outputting the induced alternating current power; and an outlet section for supplying the outputted certain alternating current power.

The transformer includes a primary coil section for inputting the alternating current power induced from the non-directional frequency generator; a first secondary coil section for inducing a higher voltage for driving a magnetron; a filament coil section for supplying a filament voltage to drive the magnetron; and a second secondary coil section for inducing commonly used alternating current power to supply the commonly used alternating current power.

The first secondary coil section, the second secondary coil section, and the filament coil section are switched on/off by first, second, and third switching sections, respectively, in a manner that the first and third switching sections are switched on to drive the first secondary coil section and the filament coil section for driving the magnetron, while, the second switching section is switched on to drive the second secondary coil section for supplying the certain alternating current power.

The microwave oven includes a button inputting section having a microwave oven operating button for driving the magnetron, and a voltage supplying button for outputting the certain alternating current power, and the first to third switching sections are on/off controlled by a microcomputer in accordance with a selection made through the button inputting section. The first and third switching sections, and the second switching section are driven separately, or simultaneously. The first to third switching sections are relays.

The outlet section for supplying the certain alternating current power is a socket outlet.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
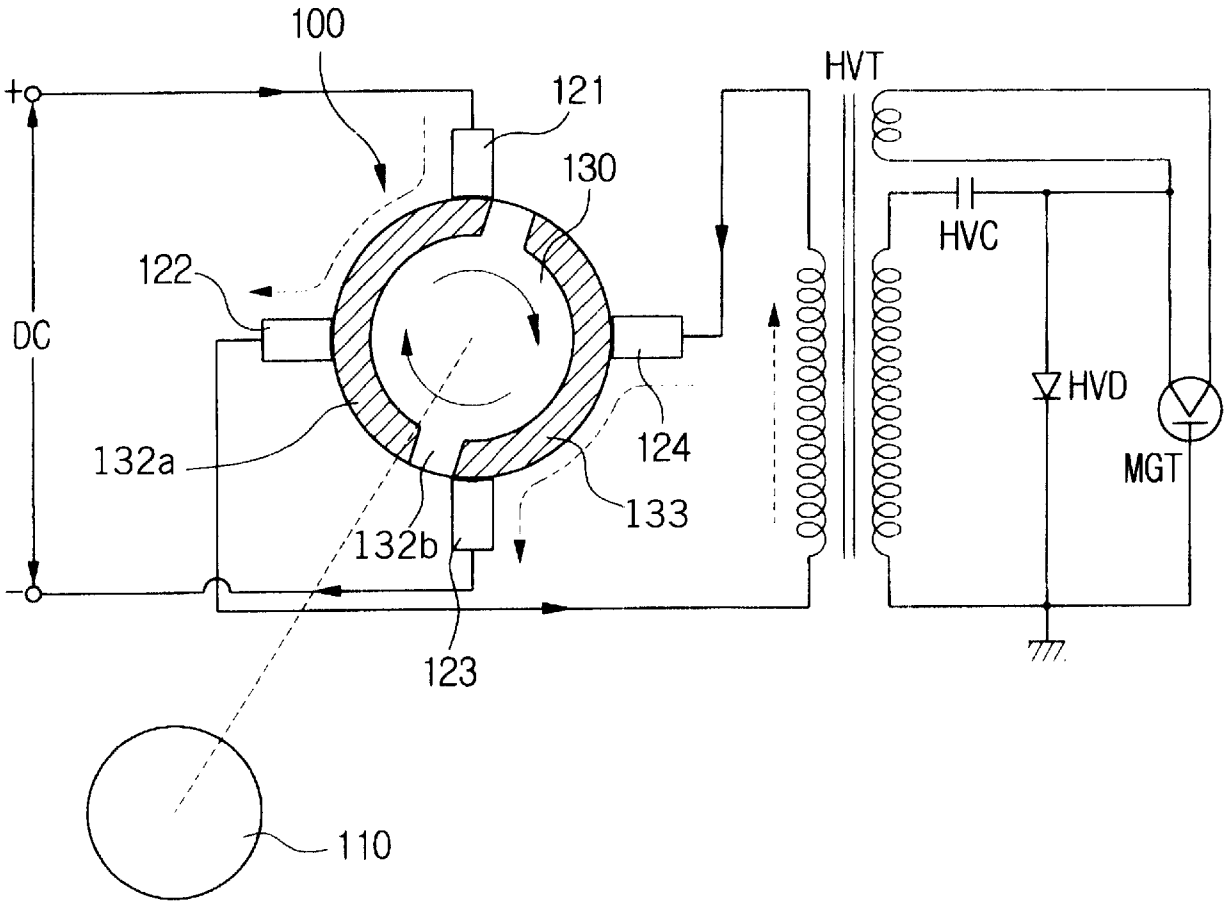
FIG. 1 (RELATED ART)
FIG. 1 is a circuit diagram for showing a magnetron driving section of an AC/DC type microwave oven according to a related art of the present invention.

Hereinafter, the preferred embodiment of the present invention will be described in greater detail with reference to the accompanied drawings, while the like elements are referred to by the same reference numerals throughout.

Figure 2:
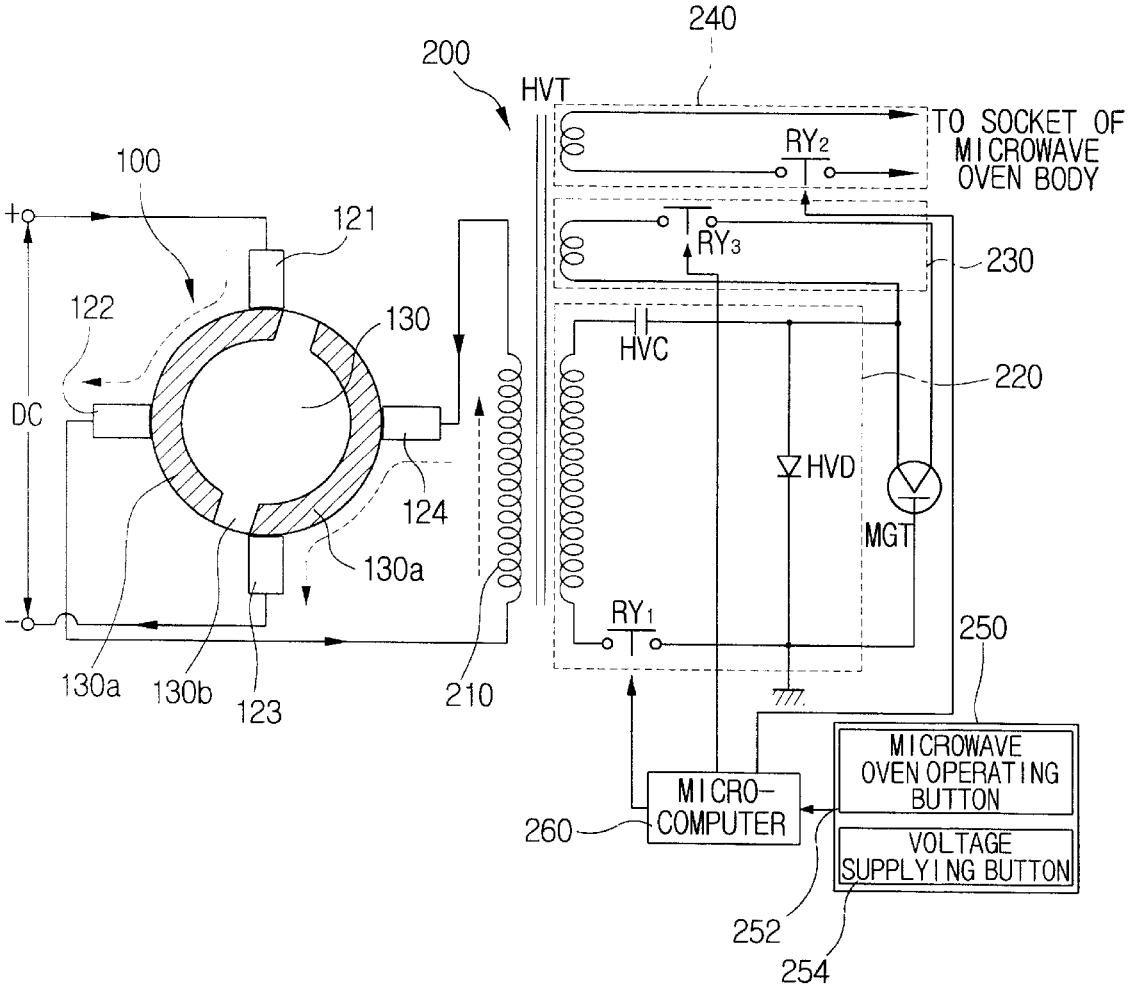
FIG. 2 is a circuit diagram for showing a magnetron driving section of a microwave oven capable of supplying alternating current power according to a preferred embodiment of the present invention.
Figure 3:
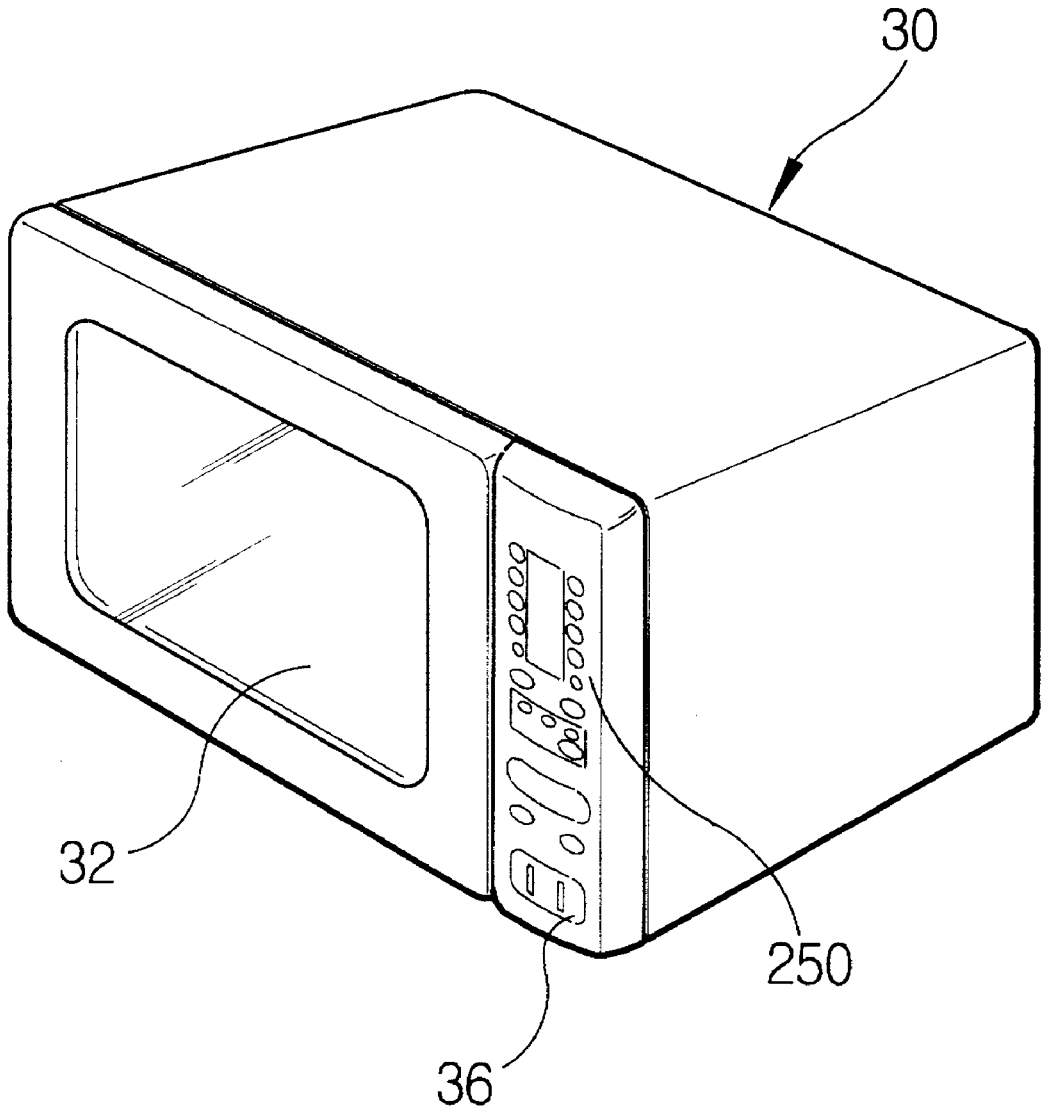
FIG. 3 is a perspective view for showing the outer appearance of the microwave oven capable of supplying the alternating current power shown in FIG. 2.

FIG. 2 is a circuit diagram for showing the magnetron driving section of a microwave oven capable of supplying alternating current power (hereinafter called AC power) according to a preferred embodiment of the present invention, and FIG. 3 is a perspective view for showing the 12 outer appearance of the microwave oven capable of supplying AC power shown in FIG. 2.

Referring to FIG. 2, the commutator 130 of the non-directional frequency generator 100 (hereinafter called HDFG) includes a conductive part 130*a* formed on the outer circumference of the commutator 130 and is divided into an even number of parts, but into at least two parts as shown in FIG. 2, having an insulating part 130*b* of a certain width formed therebetween. The conductive parts 130*a* are in simultaneous contact with at least two neighboring brushes of the first to fourth brushes 121–124. As the commutator 130 is rotated by DC power, the NDFG supplies AC power while the respective brushes 121–124 in contact with the outer circumference of the commutator 130 come in contact with the respective parts formed on the outer circumference of the commutator 130 sequentially.

In order to induce the AC power outputted from the NDFG 100 into commonly used voltages, i.e., 110V or 220V, and further to output the commonly used voltages, a transformer 200 is disposed.

The transformer 200 includes a primary coil section 210 for inputting the AC power generated from the NDFG 100, a first secondary coil section 220 for inducing a higher voltage for driving the magnetron MGT, a filament coil section 230 for supplying filament voltage for driving the magnetron MGT, and a second secondary coil section 240 for inducing the commonly used voltage to supply the commonly used AC power.

The first secondary coil section 220 is switched on/off by a first switching section, such as a first relay RY1, while the second secondary coil section 240 is switched on/off by a second switching section such as a second relay RY2. The filament coil section 230 is switched on/off by a third switching section such as the third relay RY3.

In order to drive the magnetron MGT, the first and third relays RY1 and RY3 are switched on to drive the first secondary coil section 220 and the filament coil section 230, while, in order to supply the commonly used AC power, the second relay RY2 is switched on to drive the second secondary coil section 240.

The microwave oven includes a button inputting section 250 having a microwave oven operating button 252 for driving the magnetron MGT, and a voltage supplying button 254 for outputting the commonly used voltages. The first to third switching sections are on/off controlled by a microcomputer 260 according to the selection made through the button inputting section 250.

That is, when operating the microwave oven, the first and third switching sections are driven by the microcomputer 260, while, when supplying the commonly used voltages, the second switching section is driven by the microcomputer 260. The operation of the microwave oven, and the supply of the commonly used voltages may be performed separately, or simultaneously.

The operation of the magnetron driving section of FIG. 2, having the above-described construction will be described.

First, as the power is turned on in the microwave oven, the NDFG 100 is driven. Accordingly, the commutator 130 is rotated by the motor 110, and the brushes 121–124 in contact with the respective parts formed on the outer circumference of the commutator 130 come in contact with the respective parts, sequentially, generating AC power.

A user can select the microwave oven operating button 252, or the voltage supplying button 254 on the button inputting section 250.

First, when the user selects the microwave oven operating button 252 on the button inputting section 250 of the AC/DC type microwave oven shown in FIG. 2, the microcomputer 260 switches on the first and third relays RY1 and RY3, while switching off the second relay RY2.

Accordingly, the AC power generated from the NDFG 100 is applied to the primary coil 210 of the transformer 200, and is stepped up to the higher voltage at the first secondary coil section 220 of the transformer 200. Then, by the operation of the first secondary coil section 220 and the filament coil section 230, the higher voltage operates the magnetron MGT. The magnetron MGT generates the microwaves, and the microwave oven is operated.

Second, when the user selects the voltage supplying button 254, the microcomputer 260 switches off the first and third relays RY1 and RY3, while switching on the second relay RY2.

Accordingly, the AC power generated from the NDFG 100 is applied to the primary coil 210 of the transformer 200, and is induced to the commonly used voltages by the second secondary coil section 240. The commonly used voltages are supplied to the external electronic appliances through an AC power outlet section 36 (See FIG. 3), such as a socket outlet formed on the body of the microwave oven.

FIG. 3 shows the outer appearance of the AC/DC type microwave oven of FIG. 2. In FIG. 3, a reference numeral 30 indicates the body of the microwave oven, 32 is a door, 250 is a button inputting section, and 36 is an AC power supplying section. Here, since the body 30, the door 32, and the button inputting section 250 of the microwave oven are constructed in a general manner, a further detailed description thereof will be omitted. The AC power supplying section 36 is an outlet through which the commonly used voltages generated at the second secondary coil section 240 are supplied, and a socket outlet, etc., can be used.

Accordingly, when a user wants to use AC electric appliances in a place where AC power is not available, he/she may use the AC power supplied from the AC power supplying section 36 of the microwave oven. That is, by plugging in the plug into the AC power supplying section 36, the AC power is supplied to the AC electric appliances.

As described above, in the microwave oven capable of supplying AC power according to a preferred embodiment of the present invention, when AC power is applied to the primary coil section of the transformer from the NDFG, the AC power is stepped up to a higher voltage at the first secondary coil section, and the magnetron is driven by the first secondary coil section and the filament coil section. Accordingly, the microwave oven is driven. Meanwhile, the AC power applied to the primary coil section can be induced to the commonly used power by the second secondary coil section, and the commonly used voltages are supplied to external electric appliances.

Accordingly, where DC power alone is available, the user may use the AC type electric appliances by utilizing the microwave oven according to the present invention.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A microwave oven capable of supplying alternating current power, comprising:

a non-directional frequency generator for inputting direct current power and outputting alternating current power;

a transformer for inducing the alternating current power outputted from the non-directional frequency generator into a certain alternating current power of a predetermined voltage, and for outputting the induced alternating current power to drive said microwave oven; and an electrical connector on said microwave oven for supply the outputted certain alternating current power performed independently from said driving of said microwave oven.

2. The microwave oven as claimed in claim 1, wherein the transformer comprises:

a primary coil section for inputting the alternating current power induced from the non-directional frequency generator;

a first secondary coil section for inducing a higher voltage to drive a magnetron;

a filament coil section for supplying a filament voltage to drive the magnetron; and a second secondary coil section for inducing commonly used alternating current power to supply said certain alternating current power.

3. The microwave oven as claimed in claim 2, wherein the first secondary coil section, the second secondary coil section, and the filament coil section are switched on/off by first, second, and third switching sections, respectively, in a manner that the first and third switching sections are switched on to drive the first secondary coil section and the filament coil section for driving the magnetron, while, the second switching section is switched on to drive the second secondary coil section for supplying the certain alternating current power.

4. The microwave oven as claimed in claim 3, wherein the microwave oven comprises a button inputting section having a microwave oven operating button for driving the magnetron, and a voltage supplying button for outputting the certain alternating current power, and the first to third switching sections are on/off controlled by a microcomputer in accordance with a selection made through the button inputting section.

5. The microwave oven as claimed in claim 3, wherein the first and third switching sections, and the second switching section are driven separately, or simultaneously.

6. The microwave oven as claimed in claim 3, wherein the first to third switching sections are relays.

7. The microwave oven as claimed in claim 1, wherein the electrical connector for supplying the certain alternating current power is a an electrical socket.

8. The microwave oven of claim 7, wherein said electrical socket connector supplies alternating current power separately and simultaneously to power supplied to a magnetron of said microwave oven.

9. A microwave oven, comprising:

a direct current power supply to supply power to said microwave oven;

an inverter for converting said direct current power to alternating current power within said microwave oven; and an electrical socket on an outside wall of said microwave oven to supply alternating current to another electrical appliance, wherein operation of said microwave oven and said another electrical appliance may be performed separately and simultaneously.

10. The microwave oven of claim 9, wherein said inverter comprises:

a non-directional frequency generator; and a transformer comprising a primary winding and two secondary windings, wherein one of said two secondary windings powers a magnetron which powers said microwave oven and the other of said two secondary windings powers said electrical socket disposed on said outside wall of said microwave oven.

11. The microwave oven of claim 10, further comprising a filament coil for supplying a filament voltage to drive said magnetron.

12. The microwave oven of claim 9, further comprising a control panel on said outside wall, said control panel comprising a button for operating said microwave oven.

13. The microwave oven of claim 9, further comprising a control panel on said outside wall, said control panel comprising a button for energizing said electrical socket on said wall of said microwave oven to deliver alternating current to another appliance.

14. A microwave oven, comprising:

a non-directional frequency converter for receiving direct current from an outside source and converting said direct current into an alternating current;

a transformer connected to said non-directional frequency converter, said transformer comprising a primary winding and two secondary windings;

a magnetron for operating said microwave oven, said magnetron connected to one of said two secondary windings;

an electrical connector connected to an other one of said two secondary windings, said electrical connector being disposed on an outside wall of said microwave oven, said electrical connector providing alternating current to electrical appliances that require alternating current as a power source; and a control panel for selectively operating said magnetron or said electrical connector.

15. The microwave oven of claim 14, wherein said control panel is installed on said outside of said microwave oven, said control panel comprising two buttons, the first of which activates said one of said two secondary windings to enable operation of said microwave oven, and the second of said two buttons activates said other of said two secondary windings to energize said electrical connector located on said wall of said microwave oven enabling electrical appliances requiring an alternating current power source to operate independently of as well as simultaneously with said magnetron of said microwave oven.

16. The microwave oven of claim 15, further comprising a filament coil for supplying a filament voltage to drive said magnetron.

17. The microwave oven of claim 15, further comprising a plurality of relay switches that energize one or both of said two secondary windings of said transformer depending on whether said buttons on said control panel are pressed.

18. The microwave oven of claim 17, further comprising a microcomputer to actuate said plurality of relay switches when said buttons on said control panel are pressed.

* * * * *